US008136849B2

(12) United States Patent
Hakemann

(10) Patent No.: US 8,136,849 B2
(45) Date of Patent: Mar. 20, 2012

(54) FURNITURE ITEM HAVING A FURNITURE CLOSURE

(76) Inventor: Fritz Hakemann, Goldenstedt (DE)

( * ) Notice: Subject to any disclaimer, the term of this patent is extended or adjusted under 35 U.S.C. 154(b) by 290 days.

(21) Appl. No.: 12/516,425

(22) PCT Filed: Nov. 20, 2007

(86) PCT No.: PCT/EP2007/010038

§ 371 (c)(1),
(2), (4) Date: May 27, 2009

(87) PCT Pub. No.: WO2008/046666

PCT Pub. Date: Apr. 24, 2008

(65) Prior Publication Data

US 2010/0066221 A1 Mar. 18, 2010

(30) Foreign Application Priority Data

Nov. 28, 2006 (WO) ..... PCT/EP2006/011428

(51) Int. Cl.
*E05C 19/10* (2006.01)
*E05C 19/00* (2006.01)

(52) U.S. Cl. ..... 292/95; 292/96; 292/100; 292/121; 292/126; 292/200; 292/219; 292/226; 292/DIG. 61

(58) Field of Classification Search ..... 292/95, 292/96, 100, 121, 126, 194, 195, 200, 219, 292/220, 226, DIG. 61
See application file for complete search history.

(56) References Cited

U.S. PATENT DOCUMENTS

| | | | | | |
|---|---|---|---|---|---|
| 136,731 | A | * | 3/1873 | Idly | 292/126 |
| 2,469,113 | A | * | 5/1949 | Hooker | 292/332 |
| 4,093,176 | A | * | 6/1978 | Contastin | 249/167 |
| 4,893,850 | A | | 1/1990 | Mizusawa | |
| 4,930,818 | A | | 6/1990 | Gerhardsson | |
| 5,127,684 | A | * | 7/1992 | Klotz et al. | 292/113 |
| 5,294,157 | A | * | 3/1994 | Smith et al. | 292/25 |
| 5,868,478 | A | * | 2/1999 | Yemini | 312/332.1 |
| 6,547,289 | B1 | * | 4/2003 | Greenheck et al. | 292/126 |
| 6,550,824 | B1 | * | 4/2003 | Ramsauer | 292/126 |
| 7,048,347 | B1 | * | 5/2006 | Liu | 312/332.1 |

FOREIGN PATENT DOCUMENTS

| | | | |
|---|---|---|---|
| DE | 8220662 | | 10/1982 |
| DE | 10154934 | A1 | 5/2003 |
| EP | 213310 | B1 | 8/1991 |
| EP | 660056 | B1 | 10/1998 |
| FR | 2336859 | A | 7/1977 |
| FR | 2623779 | | 6/1989 |
| FR | 2630489 | | 10/1989 |
| JP | 2005002698 | A | 1/2005 |
| JP | 2005226247 | A | 8/2005 |
| WO | WO 2006/068629 | | 6/2006 |

* cited by examiner

*Primary Examiner* — Carlos Lugo
(74) *Attorney, Agent, or Firm* — Jacobson Holman PLLC

(57) ABSTRACT

The invention relates to a furniture closure for doors, shutters and drawers, in particular for cabinets and the like in the vehicle sector. In order to provide a furniture closure which, while being particularly straightforward to design and produce, ensures sealed and secured closure of doors, shutters (3) and drawers, a profile rail (5) having a seal (6), a grip strip and a locking element (7) is arranged along the peripheral region thereof and can be pivoted about a horizontal axis (23). The seal (6) has a spring force which retains the locking element (7) in the closure position and can be compressed for the opening position.

34 Claims, 15 Drawing Sheets

FURNITURE ITEM HAVING A FURNITURE CLOSURE

CROSS-REFERENCE TO RELATED APPLICATIONS

The present patent application is a nationalization of International application No. PCT/EP2007/010038, filed Nov. 20, 2007, which is based on, and claims priority from, Application No. PCT/EP2006/011428, filed Nov. 28, 2006, both of which are incorporated herein by reference in their entireties.

BACKGROUND OF THE INVENTION

1. Field of the Invention

The invention relates to a furniture closure for doors, flaps and drawers, which in each case cover an opening of the furniture item or are received in the opening, contact surfaces of the door or flap or a front panel of the drawer projecting over the opening and engaging in the closed position on a mating surface of the furniture item.

The invention is fundamentally suitable for all furniture items having doors, flaps and/or drawers. However, the invention is particularly intended for cabinets and the like in the vehicle sector, i.e. for land vehicles, water craft and air craft, in which it is necessary to ensure a secure closure in virtually all positions and in substantially all circumstances. A preferred field of use is constituted by air conditioning cabinets, e.g. heating, cooling or freezing cabinets, in which the products to be kept hot, cold or frozen are stored in compartments and/or drawers.

2. Related Art

In order to achieve air conditioning with a minimum energy consumption it is necessary to have a tight seal of the compartments and drawers, whilst simultaneously allowing a secured closure, as well as an easy, rapid opening and reclosure.

It is known to provide circumferential sealing profiles on doors or also on mating surfaces, which surround a cabinet compartment or a furniture opening for a drawer and against which strikes a door, flap or front panel of a drawer. Generally sealing profiles constructed in bellows-like manner or also magnetic seals are used, which assist the closure of the flaps, drawers, doors and the like.

For closing purposes use is made of magnetic closures, pressure closures or spring elements.

Magnetic seals are relatively costly and not suitable for any drawer or compartment construction. In addition, cold spots can arise, which have a disadvantageous effect. A disadvantage of bellows seals is that they cannot be cleaned or can only be cleaned with significant effort and therefore there is a risk of bacteria being introduced into the air conditioning cabinet whenever the door, flap, etc. is closed.

SUMMARY OF THE INVENTION

The object of the invention is to provide a furniture closure, particularly for cabinets and the like in the vehicle sector, which has a particularly simple construction and an inexpensive manufacture and which ensures a tight, secured closure and an easy opening of doors, flaps and drawers and which permits an efficient cleaning, particularly of the seal.

According to the invention this object is achieved by a furniture closure for doors, flaps and drawers, which in each case cover an opening of the furniture item or are received in the opening, contact surfaces of the door or flap or a front panel of the drawer projecting over the opening and engaging in the closed position on a mating surface of the furniture item, wherein the door, flap or front panel is provided in a marginal area with a profile rail, which is equipped with a seal and a locking member and which is movable from a closed position into an open position and vice versa.

It is a fundamental principle of the invention to equip a door, flap or drawer with a closure construction, which exerts a tightening torque and ensures locking and unlocking, together with pivoting of the door, flap and drawer from an open position into a secured closed position and vice versa.

According to the invention a furniture closure for doors, flaps and drawers, which in each case cover or are received in the opening of a furniture item, contact surfaces of the door, flap or a front panel of the drawer projecting over the opening and engaging in the closed position on mating surfaces of the furniture item, has a profile rail, which is marginally located, e.g. in an upper or lateral area of the door, flap or front panel. The profile rail is provided with a seal and with a locking member and can be pivoted from the closed position into an open position.

It is advantageous that the profile rail is constructed for receiving a seal with spring action and that the profile rail with the seal, which serves as a spring element for the closure position, as well as the locking member can be moved about a horizontal axis. As a result of its spring tension the seal presses the locking member into the locking position, so as to ensure secured locking of the door, flap or drawer without an additional spring element.

When positioned in an upper area, e.g. of a flap or front panel, the seal and the profile rail can extend over the entire width of the upper area of the door, flap or front panel of the drawer, a seal sealing the entire furniture opening and is also located on the longitudinal sides and on the lower transverse side.

Use is made with particular advantage of seals having a high spring tension and which keeps the locking member in the closed position. Preference is given to seals made from an elastomeric plastic or foamed rubber. In addition, lip seals and cellular seals are advantageous.

Appropriately a springy seal with insulating characteristics is used for the furniture closures of air conditioning cabinets.

The pivot pin located in the longitudinal direction of the profile rail is appropriately constructed in hinge or joint-like manner. The profile rail can also be movably fixed with the aid of a band or elastomeric hinge, a pivot joint or by pivot pins to the door, flap or front panel of a drawer.

For opening and closing the door, flap or drawer the profile rail is advantageously provided with a gripping strip. To limit the pivoting movement of the profile rail from the closed position into the open position at least one tilt stop is also provided.

In a particularly simple constructional variant the profile rail can have a cross-sectional roughly I or T-shaped construction, whilst having a vertical leg relative to an arrangement on an upper area of the flap, front panel, etc. The vertical leg can be used for fastening the profile to the side of the door, flap or drawer front panel facing the furniture opening and can e.g. receive a hinge, which can be spring biased.

The horizontal leg can have an asymmetrical or an outwardly beveled construction and terminally passes into the gripping strip. In a further variant the horizontal leg of the profile rail can be provided on an inside with a fixing strut for anchoring the seal.

In a further variant the profile rail can be constructed in two parts and a first part has a joint, e.g. a universal or shaft joint, whilst the second part has a joint receptacle, e.g. a universal or shaft seat, in which the joint is received and the horizontal axis of the profile rail formed. The first part of the profile rail has the vertical leg with the seal anchored therein, e.g. in the form of a lip seal, as well as the horizontal leg with the terminal gripping strip. The second part of the profile rail with the joint receptacle or joint seat and two fastening legs arranged at an angle are used for fastening purposes, particularly to an upper area of the door, flap or extraction front of the drawer, e.g. with the aid of a knuckle joint.

Appropriately the knuckle joint extends over the joint seat with the universal or shaft joint received therein and passes into a tilt stop, which limits the pivoting movement of the first profile rail part in the open position.

The locking member can be rigidly fixed to the profile rail, appropriately to the vertical leg. It is also possible to integrate the locking member into the profile rail. The locking member projects roughly at right angles from the vertical leg of the profile rail into the opening of the cabinet body and cooperates with a strip, advantageously a taper gib strip, or a slot on a surface surrounding the furniture opening.

The profile rail can be made from metal, e.g. aluminum, or from a plastics material, e.g. PVC. The locking member can be produced in the same way.

Appropriately the seal is constructed in such a way that a linear or flat, sealing engagement on the mating surfaces of the furniture body is ensured. It is particularly advantageous to have seals, which can be compressed and provide a spring tension for moving the profile rail from the closed position into the open position and vice versa. The locking member, which is e.g. constructed as a catch member, when the profile rail is pivoted into the open position and the seal is compressed, is disengaged from a slot or a locking strip on the furniture body in or behind which the locking member engages or locks in the closed position.

The open position of the profile rail is limited by at least one tilt stop. The tilt stop can e.g. be constructed on the locking member and can cooperate with an inside of the door, flap or drawer front panel. Alternatively or additionally a tilt stop can also be provided on the underside of the horizontal leg of the I or T-shaped profile rail and cooperates with an outside of the door, flap or front panel.

The closed position of the door, flap or drawer can additionally be secured by a retaining member. The retaining member can e.g. be provided in the area of the horizontal leg and preferably is vertically movable. In the closed position the retaining member can arrest the profile rail, in that it is held on an outside of the door, flap or drawer front panel. For opening the door, flap or drawer the retaining member is moved upwards, so that it projects over the horizontal profile rail leg and no longer impedes the pivoting of the profile rail into the open position. Advantageously the retaining member is constructed as a plug-in lock.

In the case of an alternative furniture closure, which is suitable both for a horizontal arrangement in an upper area of a flap or front panel of a drawer and for a vertical arrangement on a longitudinal side of a door, the profile rail is provided with a rotary inner tube to which is fastened the springy seal, the at least one locking member and the gripping strip. The profile rail is cross-sectionally roughly semicircular or also U-shaped with relatively short U-legs and is so placed on an insulating wall of a door, flap or front panel that the U-opening is directed towards the mating surface of the furniture item.

The springy seal is constructed as a cellular seal and is on the inside held, e.g. locked or clamped to the inner tube with an arcuate sealing foot.

The inner tube is constructed in complementary manner to the profile rail in circular form with a longitudinal slot in the vicinity of the profile rail U-opening and, roughly facing the springy seal, has a flattening for receiving at least one fastening member, e.g. a fastening screw, for retaining the gripping strip. In order to ensure the movability of the inner tube with springy seal, locking member and gripping strip, in the vicinity of the fastening screw the profile rail is provided with a recess, which is advantageously dimensioned in such a way that the opening movement of the locking member is limited. Simultaneously on the inside of the door, flap or front panel, which is appropriately constructed as an insulating wall, a stop is provided for the locking member.

For fastening to a marginal area of a door, flap or front panel the profile rail is equipped with fastening feet, which are constructed in complementary manner to a metal profile of the door, flap or front panel, so that the complete profile rail can be shoved in or locked. In the vicinity of the longitudinal slot the inner tube has outwardly directed legs, which cooperate with inwardly directed leg ends of the profile rail U-leg and ensure a reliable hold.

By means of a sealing head, which can e.g. have two hollow chambers, the springy seal engages on a furniture profile or a profile seal received therein and on a strip, which in a corner area of the furniture profile projects diagonally outwards and has a slot for the locking member. The furniture profile can e.g. roughly correspond to the extrusion profile for cooling cabinets and the like described in EP 213 310 B1.

The construction of the rigidly arranged profile rail with the rotary inner tube, e.g. made from extruded plastic, and springy seal, locking element and gripping strip fixed thereto is characterized by easy manufacture and particularly high sealing and insulating action, whilst simultaneously providing a secure closure and easy opening.

Particularly on placing a profile rail with springy seal, at least one locking member and a gripping strip in a partial area, e.g. on a longitudinal side of a door, it is advantageous to increase the spring tension of the springy seal by a seal extension. The seal extension is particularly appropriately provided outside the fastening area with which the seal is e.g. held in a fastening slot of the sealing profile.

The relatively short profile rail is then provided with end caps, which can be appropriately fixed in fastening points on the marginal area of the door or flap.

In an alternative construction of a furniture closure there is a profile rail with a springy seal, at least one closure member, a gripping strip and a longitudinal side pivot pin in a marginal area of a door, flap or front panel, in which a gripping recess is formed. Once again the springy seal is provided with a seal extension and the locking member has a hook-like construction and, in the closed position, engages behind a strip located on a furniture profile.

BRIEF DESCRIPTION OF THE DRAWINGS

The invention is explained in greater detail hereinafter relative to the attached highly diagrammatic drawings, wherein show.

DETAILED DESCRIPTION OF THE PREFERRED EMBODIMENTS

Figure 1:
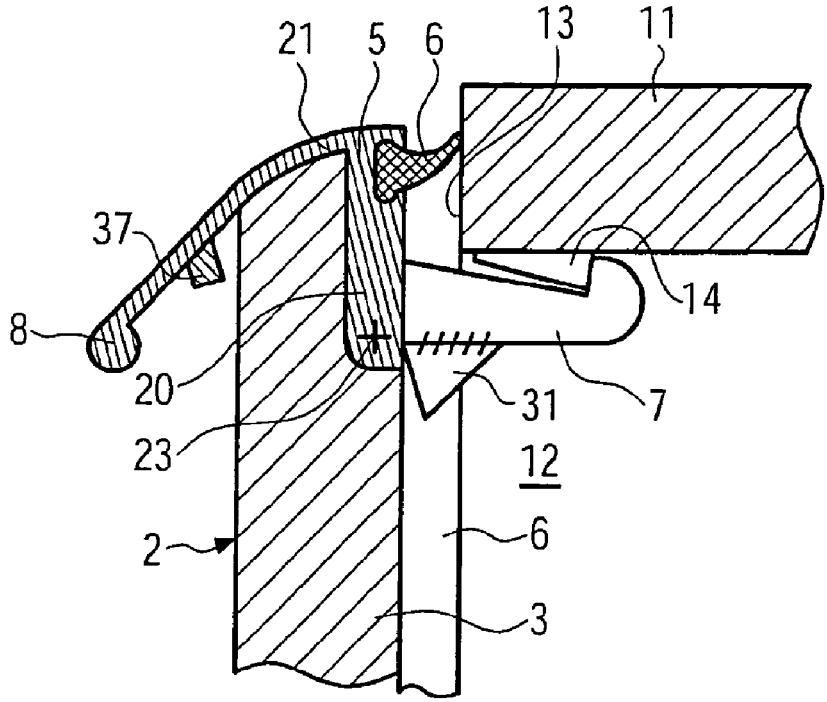
FIG. 1 A longitudinal section through an inventive furniture closure in the closed position.

FIG. 1 shows in detail form a furniture item 11, e.g. an air conditioning cabinet, with an opening 12, which is covered by a front panel 3 of a drawer 2. In this embodiment the furniture closure comprises an approximately I-shaped profile rail 5, as well as a vertical leg 20 and a horizontal leg 21 with a gripping strip 8.

The profile rail 5 is located in the upper area of the front panel 3 and extends over the entire width.

To the profile rail 5 is fastened at least one locking member 7, which is constructed as a catch member and engages behind a wedge-shaped strip 14 in the area of the furniture item 11. The profile rail 5 also has a seal 6, which in this example is constructed as a lip seal and is anchored in an approximately T-shaped slot of the profile rail 5 and acts as a spring for the closure. The seal 6 extends over the entire width of the profile rail 5 and also ensures the necessary sealing on the longitudinal sides and the lower transverse side (not shown) of the front panel 3.

Figure 2:
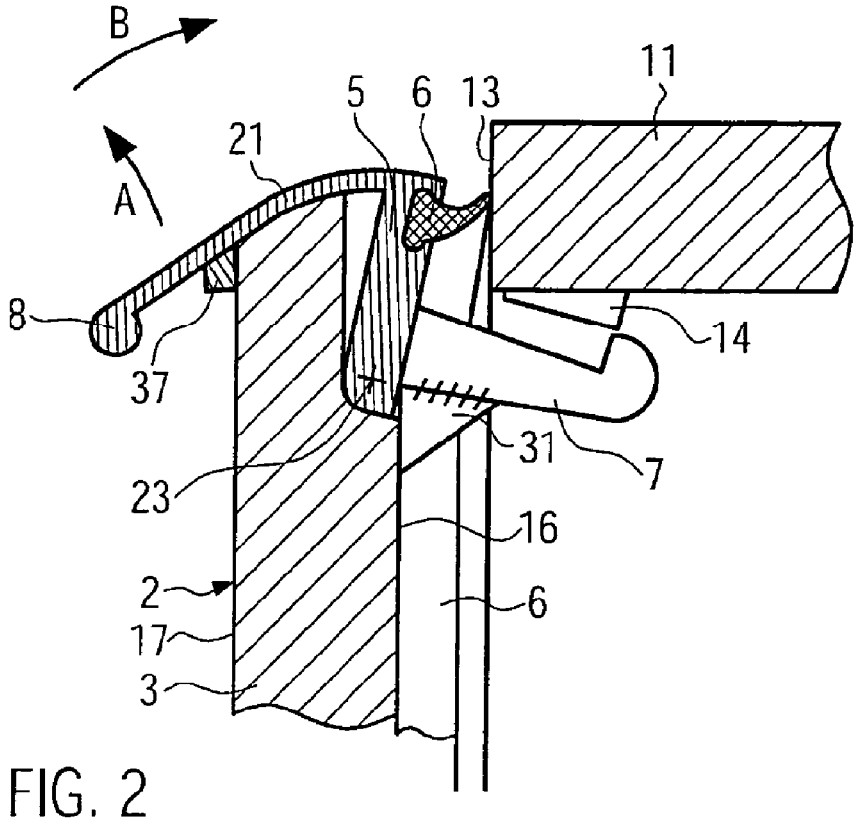
FIG. 2 A longitudinal section through the inventive furniture closure according to FIG. 1 in the open position.

FIG. 1 shows the furniture closure in the closed position, where the locking member 7 engages behind the strip 14. For the open position the profile rail 5 is pivoted in accordance with arrows A and B (cf. FIG. 2) about the longitudinal axis 23, which can e.g. be constructed as a pivot joint, the seal 6 being compressed.

Below the locking member 7 and cooperating with an inside 16 of the front panel 3 is provided a tilt stop 31, which can e.g. be welded to the locking member 7. Alternatively a second tilt stop 37 is located on the underside of the horizontal leg 21 and for limiting the opening movement of the profile rail 5 strikes against an outside 17 of the front panel 3. The locking of locking member 7 behind the taper gib strip 14 takes place as a result of the spring tension of the seal 6 in the area of the profile rail 5.

Figure 3:
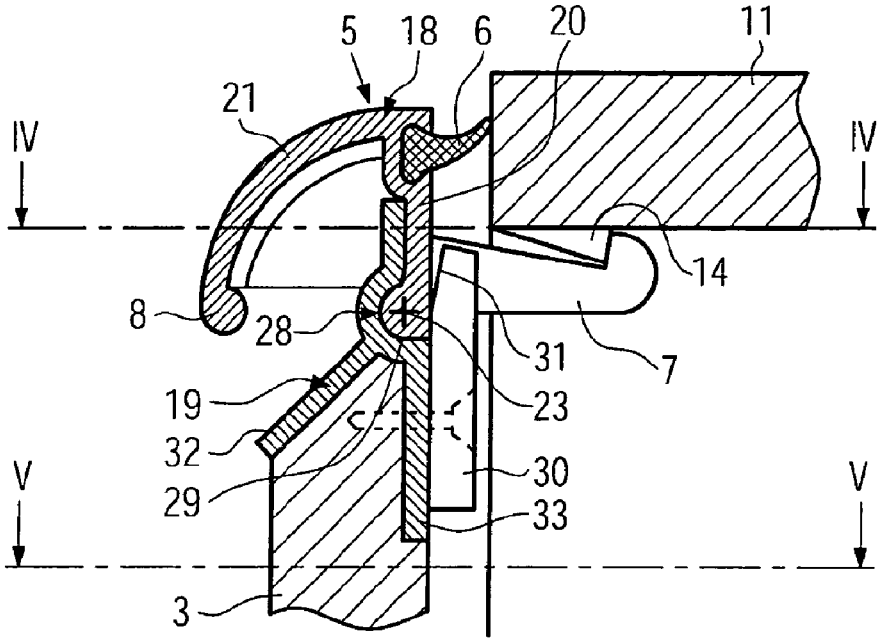
FIG. 3 A longitudinal section through a second variant of the inventive furniture closure in the closed position.

FIG. 3 shows another variant of an inventive furniture closure. The profile rail 5 is constructed in two parts with a first part 18 and a second part 19. The second part 19 is constructed for fastening to the marginal area of a door, flap or drawer front panel 3 and engages round the marginal area with complementary constructed fastening lugs 32, 33, which are forced apart in approximately V-shaped manner. The second part 19 has a joint receptacle or joint seat 29 for a universal or shaft joint 28, which is constructed on the lower area of the first part 18 of the profile rail 5 and forms the longitudinal axis 23 about which it is possible to pivot the first part 18 of the profile rail 5 from the open position into the closed position and vice versa.

FIG. 3 shows the closed position of the furniture closure. The seal 6 with spring tension is once again a lip seal located over the entire width of the profile rail 5 and a horizontal leg 21 of the profile rail 5 passes terminally into the gripping strip 8. To both sides of the horizontal profile rail 5 are fastened knuckle joints 30 (cf. also FIG. 4), which are beveled in the upper area and form a tilt stop 31. The knuckle joints 30 with a tilt stop 31 prevent a release of the first part 18 of the profile rail 5 from the second part 19 and also limit the movement of the profile rail 5 into the open position.

Figure 4:
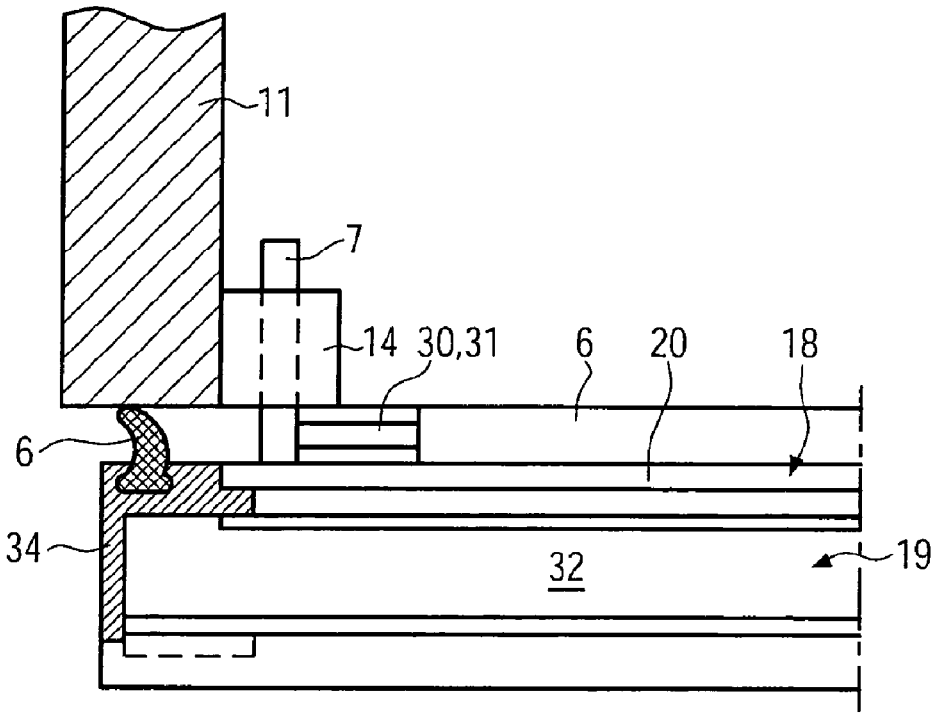
FIG. 4 A plan view along line IV-IV in FIG. 3.

FIG. 4 is a horizontal section through the left-hand corner area of the furniture closure according to FIG. 3, which shows the lip seal 6 with spring tension and an end cap 34 of the profile rail 5, together with the knuckle joint 30 with upper tilt stop 31, locking member 7 and strip 14.

Figure 5:
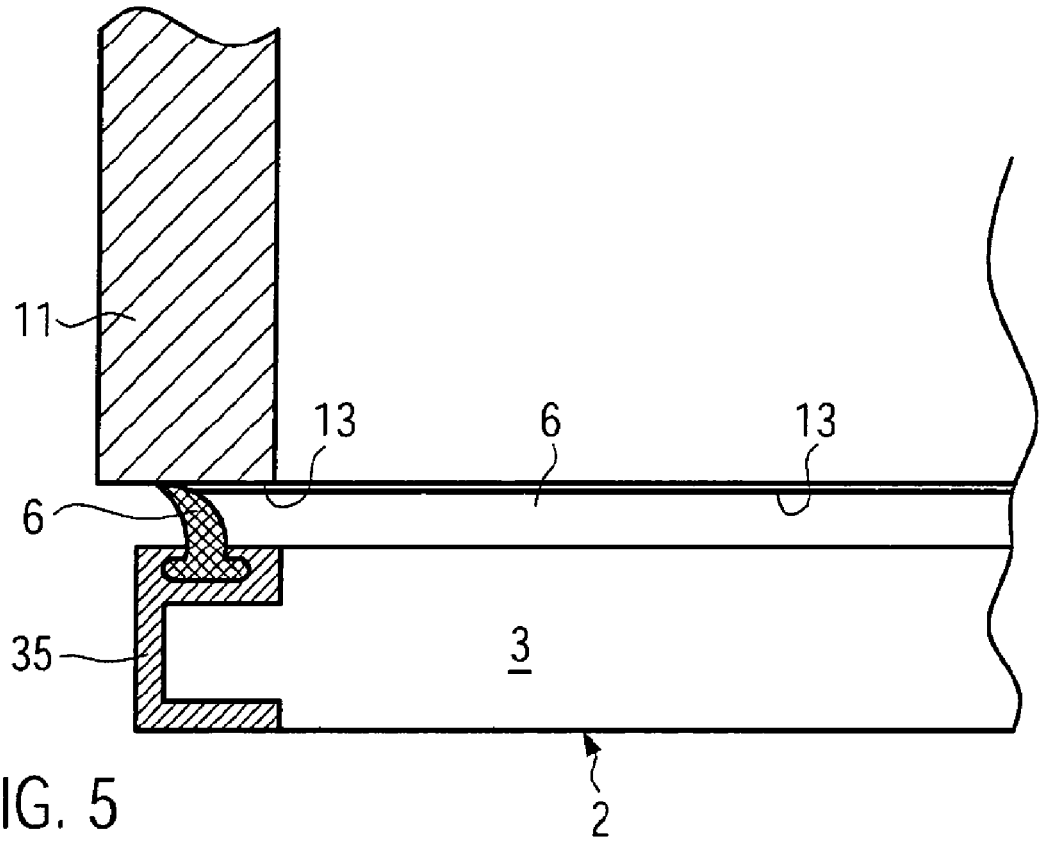
FIG. 5 A plan view along line V-V in FIG. 3.

FIG. 5 is a horizontal section in the area of the front panel 3 below the profile rail 5. The front panel 3 has an edging 35 on both longitudinal sides, whereof only the left-hand longitudinal side is shown. It is also possible to see the seal 6 on the longitudinal sides and one lower transverse side, which engage on mating surfaces 13 of the furniture body 11.

FIGS. 6 to 10 show further furniture closure variants. Identical features carry identical reference numerals.

Figure 6:
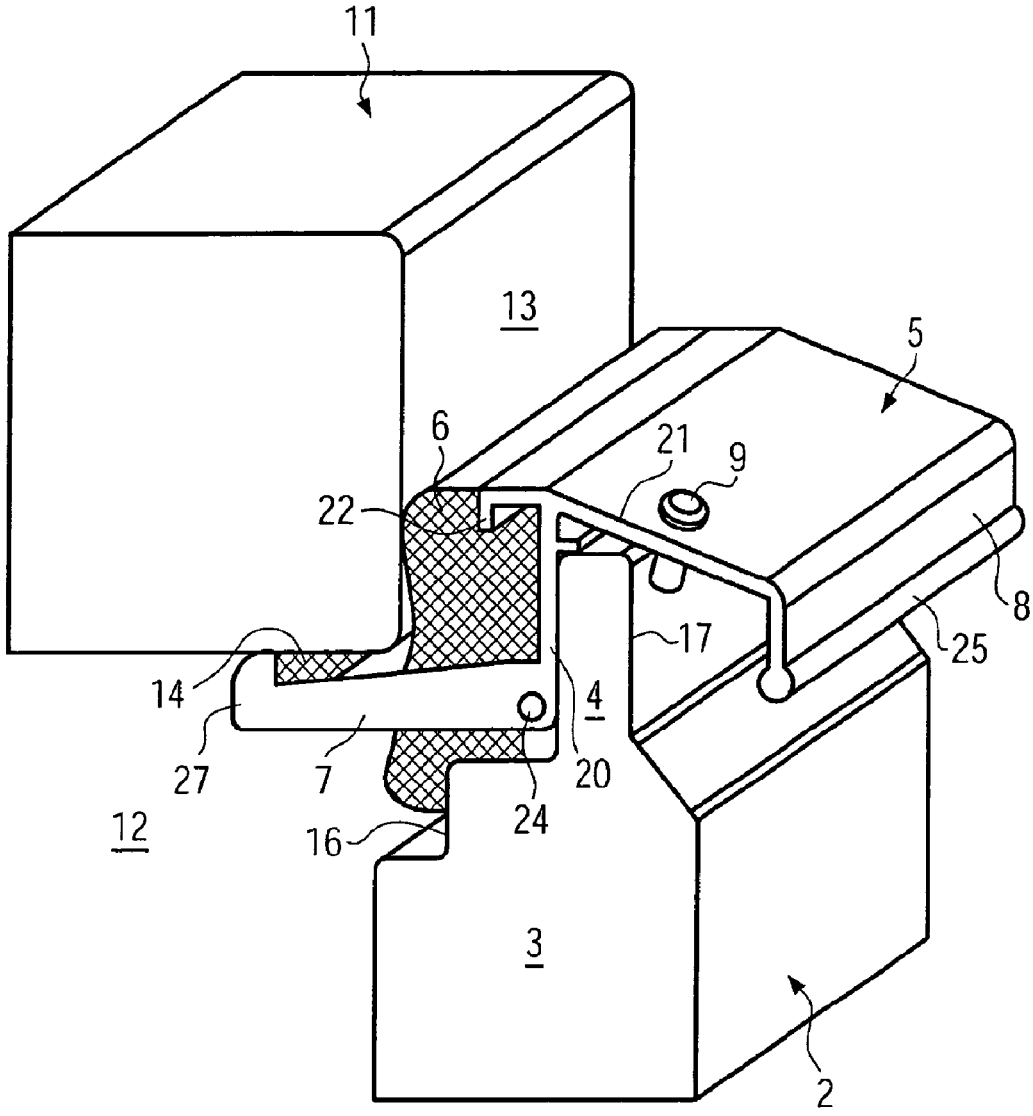
FIG. 6 A perspective detail of a third variant of the inventive furniture closure in the closed position.
Figure 7:
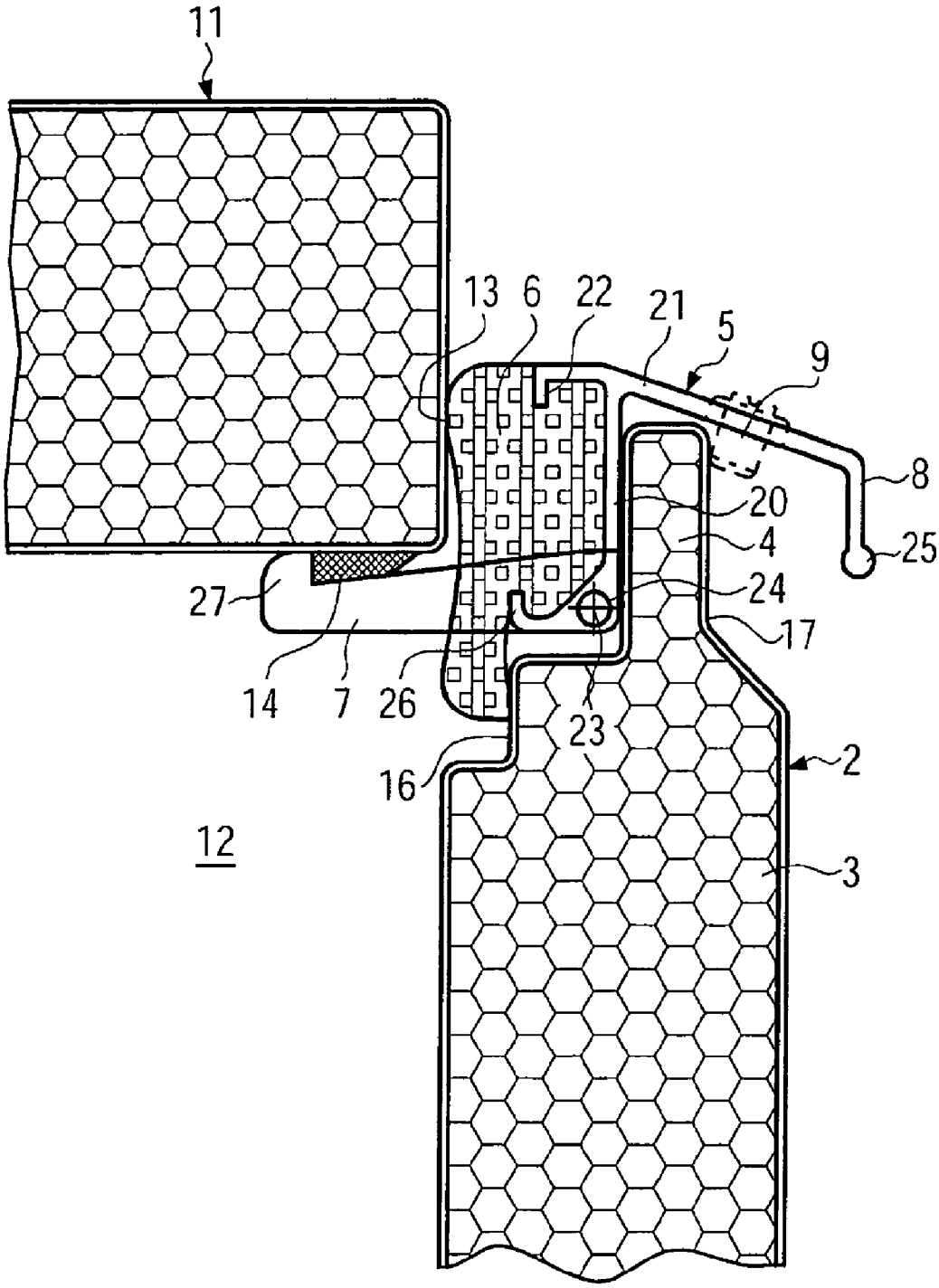
FIG. 7 A longitudinal section through the inventive furniture closure according to FIG. 6.
Figure 8:
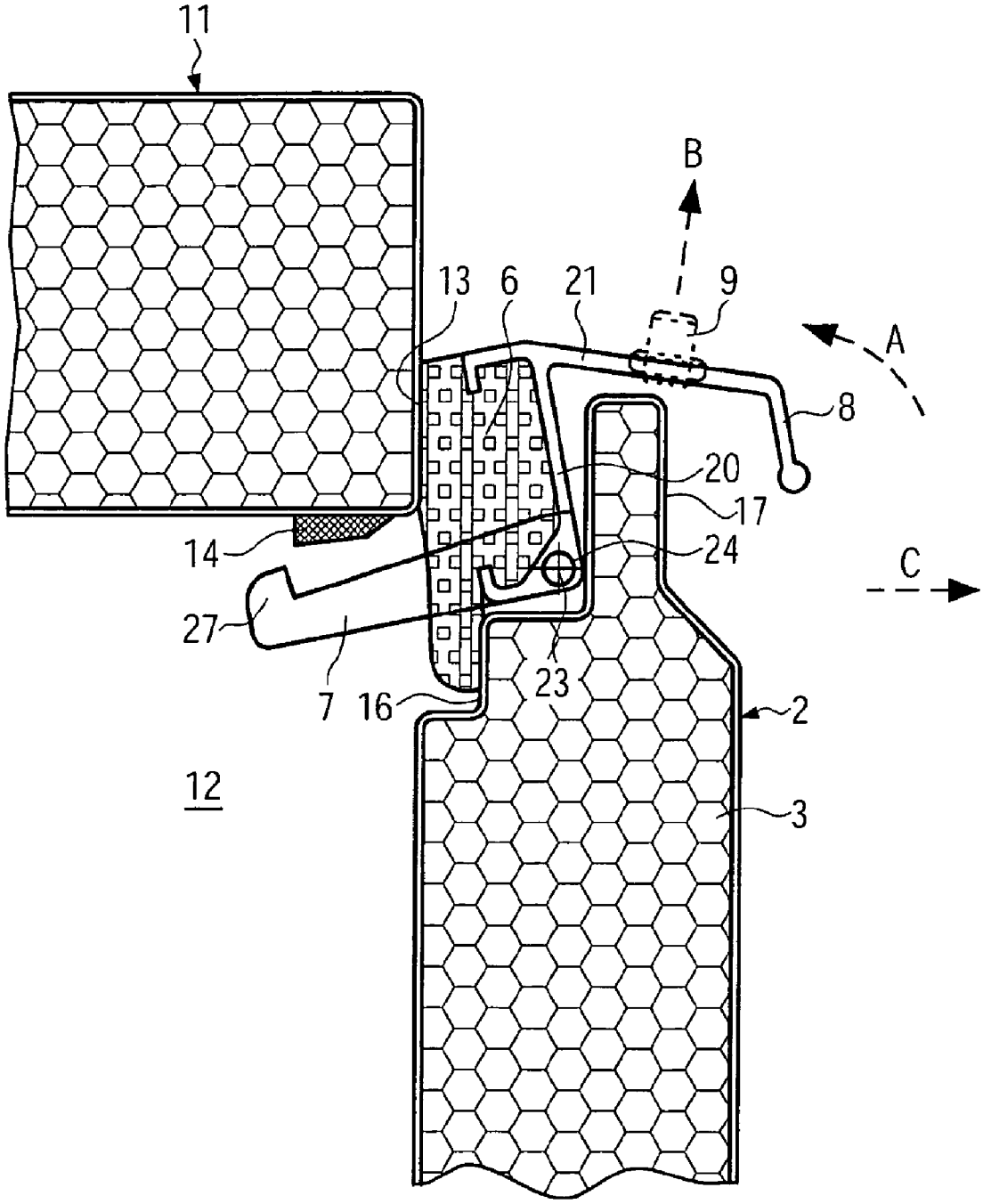
FIG. 8 A longitudinal section through the inventive furniture closure of FIGS. 6 and 7, but in the open position.

In the variant of FIGS. 6 to 8 a profile rail 5 with a seal 6 and a locking member 7 are fixed to the front panel 3 in the area of a contact surface 4 and pivotable about the horizontal longitudinal axis 23. In FIGS. 6 and 7 the profile rail 5 with seal 6 and locking member 7 are in the closed position, whereas FIG. 8 shows the open position. The locking member 7 is rigidly fixed to the profile rail 5 with the aid of a stud 24.

Profile rail 5 is cross-sectionally approximately T-shaped and is movable fixed in the area of the contact surface 4 of the front panel 3 with a vertical leg 20. An almost horizontal leg is asymmetrically constructed and extends in an inclined outwards manner over the contact surface 4 or marginal area of the front panel 3 and passes terminally into a gripping strip 8.

The gripping strip 8 is angled and provided with a bead 25.

On the inside the horizontal leg 21 is shorter and is terminally provided with an angled fastening web or strut 22 for anchoring the seal 6. A further anchoring of the seal 6 on the terminal profile 5 takes place by means of a lower fastening strut or web 26 (FIGS. 7 and 8), which is directed oppositely to the upper fastening strut 22 and therefore aids the retention of the seal 6 on or in the profile rail 5.

Seal 6 is made from an elastomeric, compressible material, so that according to arrow A in FIG. 8 it is possible for the profile rail 5 to move from the closed position of FIGS. 6 and 7 into the open position of FIG. 8.

To this end a retaining member 9, which is located on the profile rail 5 in the area of the outer horizontal leg 21, is moved from the secured position of FIGS. 6 and 7 into the open position of FIG. 8 in accordance with arrow B.

The retaining member 9 can be a plug-in lock, which in the closed position of FIGS. 6 and 7 strikes against the outside 17 of the contact surface 4 and therefore clamps the profile rail 5 in the closed position shown in FIGS. 6 and 7. After the outward movement of the retaining member 9 or over the horizontal leg 21 of the profile rail 5 in FIG. 8, it is possible to move the profile rail 5. The locking member 7 is disengaged from the strip 14, so that the drawer 2 according to arrow C can be extracted from the furniture opening 12.

The strip 14 is constructed as a taper gib strip and consequently ensures during the closing process a sliding movement of the locking member 7 or its hook 27 along the wedge surface until engagement takes place behind the strip 14 (FIGS. 6 and 7).

Figure 9:
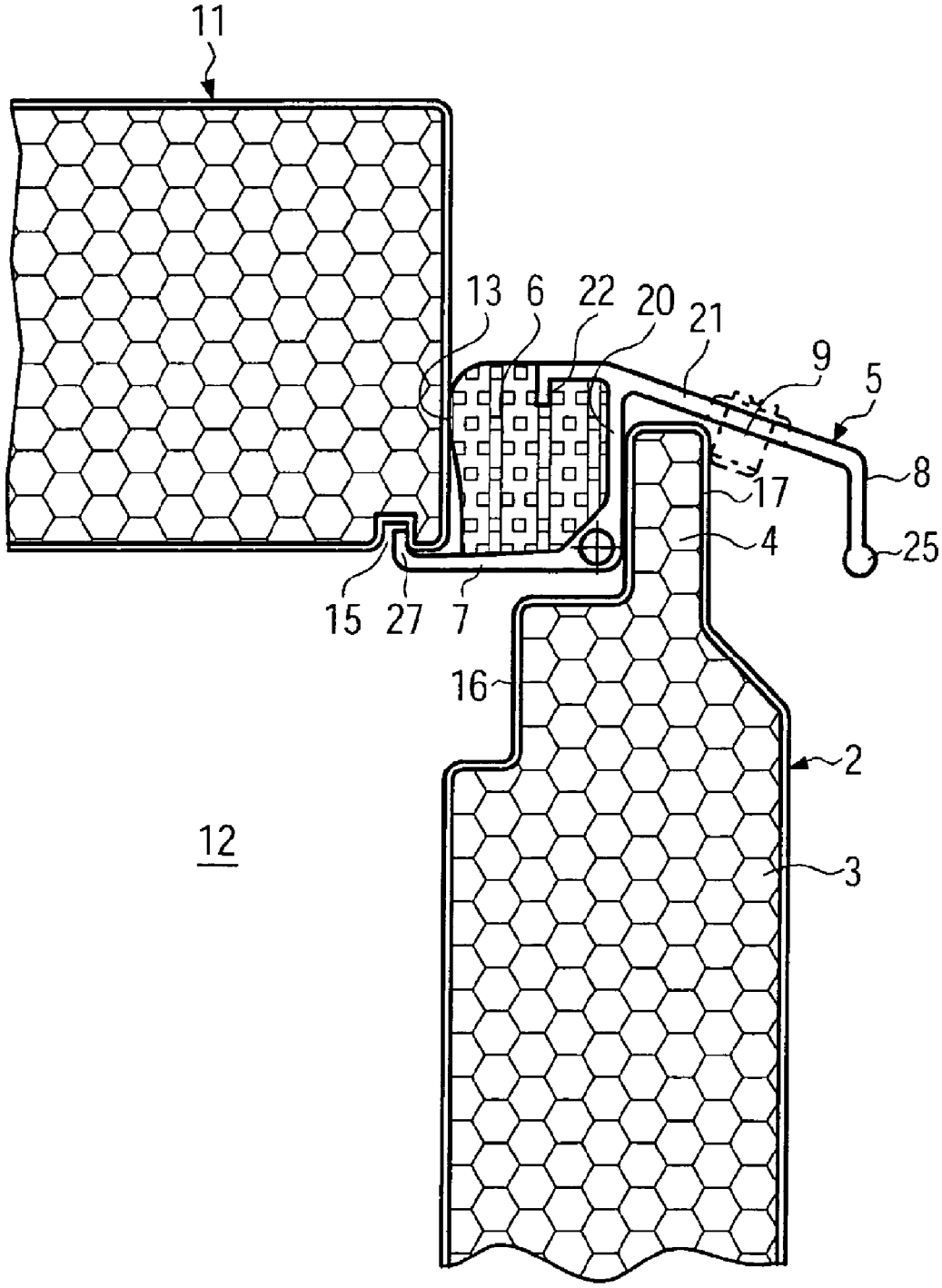
FIG. 9 A longitudinal section through a fourth variant of the inventive furniture closure in the closed position.
Figure 10:
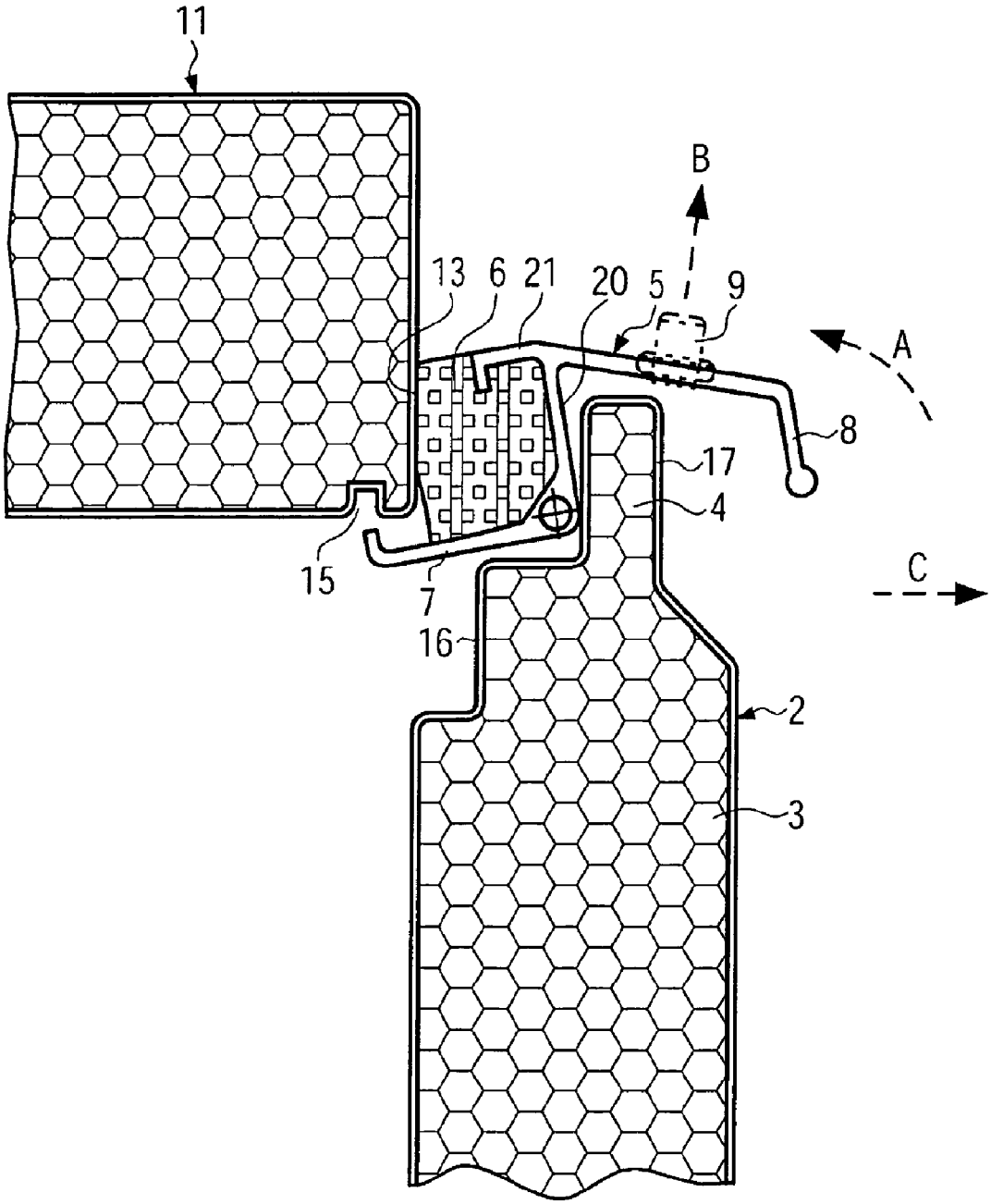
FIG. 10 A longitudinal section through the furniture closure of FIG. 9, but in the open position.

The variant of a furniture item 11 with opening 12 and drawer 2 received therein shown in FIGS. 9 and 10 does not differ from the construction of FIGS. 6 to 8 with respect to the basic closure construction with profile rail 5, seal 6, locking member 7 and retaining member 9, the difference being a different shaping of the seal 6 and locking member 7, as well as the engagement member on the furniture item 11, which is here in the form of a slot 15.

In addition, the profile rail 5 and locking member 7 form a unit. In the closed position shown in FIG. 9 the hook-like locking member 7 engages in the slot 15 of the furniture item 11 and the seal 6 engages flat on the mating surface 13 of furniture item 11. Considered in cross-section, the seal 6 extends roughly up to the locking member 7 and the open position of the profile rail 5 with seal 6 and locking member 7 shown in FIG. 10 is limited by the locking member 7 or the seal 6 and a stepped construction of the front panel 3. The function of the retaining member 9 with respect to unlocking and the extraction of drawer 2 is the same as in the variant of FIGS. 6 to 8.

Figure 18:
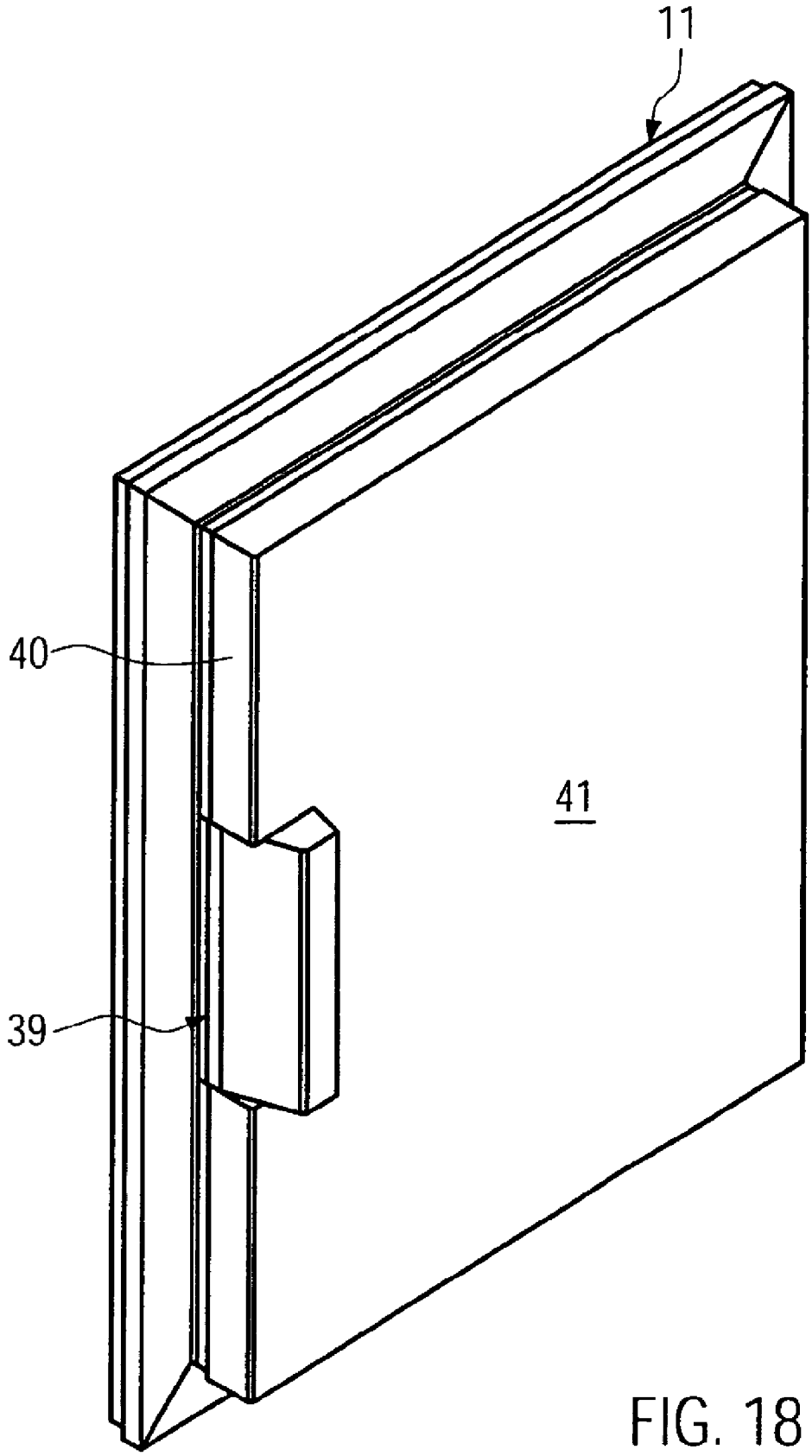
FIG. 18 A perspective view of a door of an air conditioning cabinet with an inventive furniture closure.

Another variant of a furniture closure according to FIGS. 11 to 14 is provided both for a horizontal arrangement on a flap 3 or front panel of a drawer and for a vertical arrangement on a longitudinal side 40 of a door leaf 41 of an air conditioning cabinet in the form of the furniture item 11 (cf. FIG. 18).

In this variant the profile rail 5 is firmly fastened to the marginal area of door 41 or flap 3 and is constructed in roughly semicircular or U-shaped manner as a roughly horizontal U. The profile rail 5 is constructed for receiving a rotary inner tube 51 and the springy seal 6, the at least one locking member 7 and gripping strip 8 are fastened to the inner tube 51, which can be moved about the longitudinal axis 23, and with the inner tube 51 can pass from a closed position (FIG. 13) into an open position (FIG. 14).

As a result of its construction as a cellular seal 60 with a sealing foot 61, which is held on the inside of the inner tube 51, and a sealing head 62 with two hollow chambers 63, 64 constructed for a flat engagement on the mating surface 13 of the furniture item 11, the springy seal 6 has a relatively high spring tension which effectively supports the closed and open position of the furniture closure.

In this embodiment the mating surface 13 of the furniture item 11 is formed by a furniture profile 42, which has chamber profiles 43, 44 at right angles to one another and an outwardly open corner area 45. The corner area 45 is constructed for receiving a profile seal 46 and for the engagement of the locking member 7 in the closed position. The springy seal 6 or cellular seal 60 of the profile rail 5 engages on the profile seal 46 and on a strip 14 of the furniture profile 42. The strip 14 is terminally positioned roughly diagonally in the corner area 45 and bounds a profile recess for the profile seal 46 and slot 15, in which engages the hook or nose 27 of the locking member 7.

The fixed U-shaped profile rail 5 is provided with relatively short U-legs 47, 48 and inwardly angled leg ends and is positioned horizontally with the U-opening pointing towards the mating surface 13. On the outside of the U-leg 47 are constructed in angular manner profile feet 49, 50 for fastening the profile rail 5 to the marginal area of the door, flap or front panel 3. The profile feet 49, 50 and the marginal area of the flap 3 or door 41 (FIG. 18) constructed as an insulating wall with metal covers 58, 59, are constructed in such a way that the profile rail can be shoved or clipped in and securely retained. Regarding the construction of an insulating wall of a door for a refrigerating furniture item, reference is made to EP 660 056 B1.

The inner tube 51, which in complementary manner to the U-opening of the profile rail 5 has a longitudinal opening, is provided with outwardly directed legs 52, 53, which cooperate with the leg ends of the profile rail 5. The inner tube 51 can consequently be slid into the profile rail 5, is securely retained and pivotable to a limited extent. The sealing foot 61 of springy seal 6 engages behind the longitudinal opening of the inner tube 51 and the sealing head 62 with the two hollow chambers 62, 64 projects outwardly and engages flat on the furniture profile 42 or profile seal 46.

Virtually facing the springy seal 6 the inner tube 51 has a fastening area for at least one fastening element 54, e.g. a fastening screw, with which the gripping strip 8 is held on the inner tube 51, which here has a flattened construction.

In the vicinity of the fastening screws 54 the profile rail 5 has in each case a recess 55 through which extends the fastening screw 54. The recess 55 can be dimensioned in such a way that the opening movement of the inner tube 51 with springy seal 6, locking member 7 and gripping strip 8 can be limited in predeterminable manner.

The at least one locking member 7 is fixed with the aid of fixing struts 56 in the inner tube 51 and an insulating material 57, which prevents cold spots, can additionally assist the secure retention of the locking member 7 and springy seal 6. Two protuberances 67 on inner tube 51 constructed in nipple form and which face one another, are used for arresting the locking member 7 on the inner tube 51.

Figure 11:
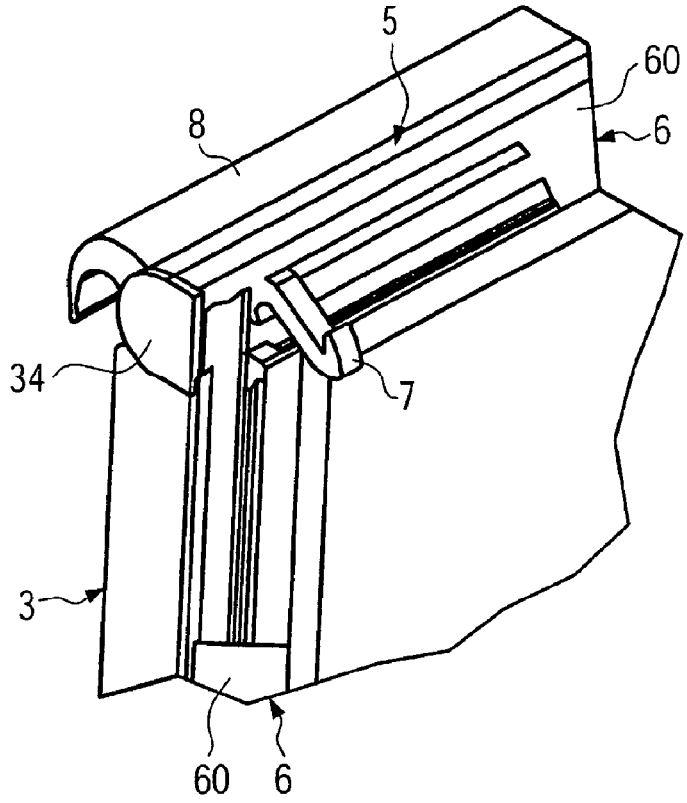
FIG. 11 A perspective detail of a fifth variant of the inventive furniture closure on a door and with a partly broken away seal.
Figure 12:
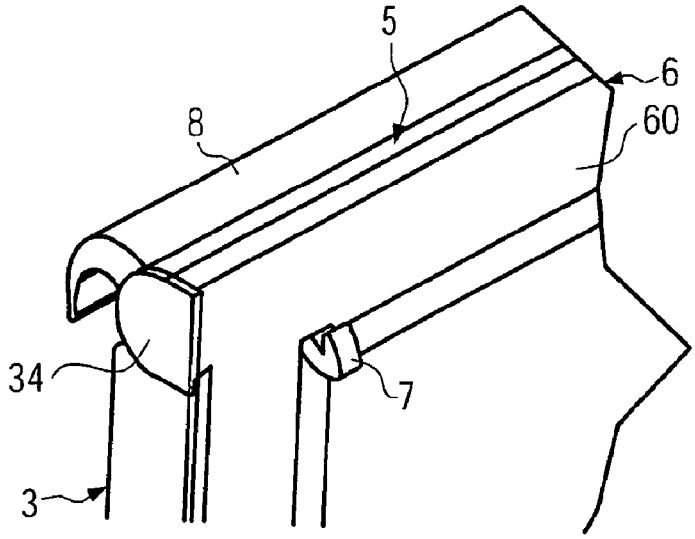
FIG. 12 A perspective detail of the furniture closure of FIG. 11 with a continuous seal.

In the perspective views of FIGS. 11 and 12 it is possible to see the locking member 7, the springy seal 6 being partly broken away in FIG. 11. The profile rail 5 is frontally provided with end caps 34 and the door 41 or flap 3 is constructed as an insulating wall (cf. FIGS. 13 and 14).

In the drawings identical components are given identical reference numerals.

Figure 13:
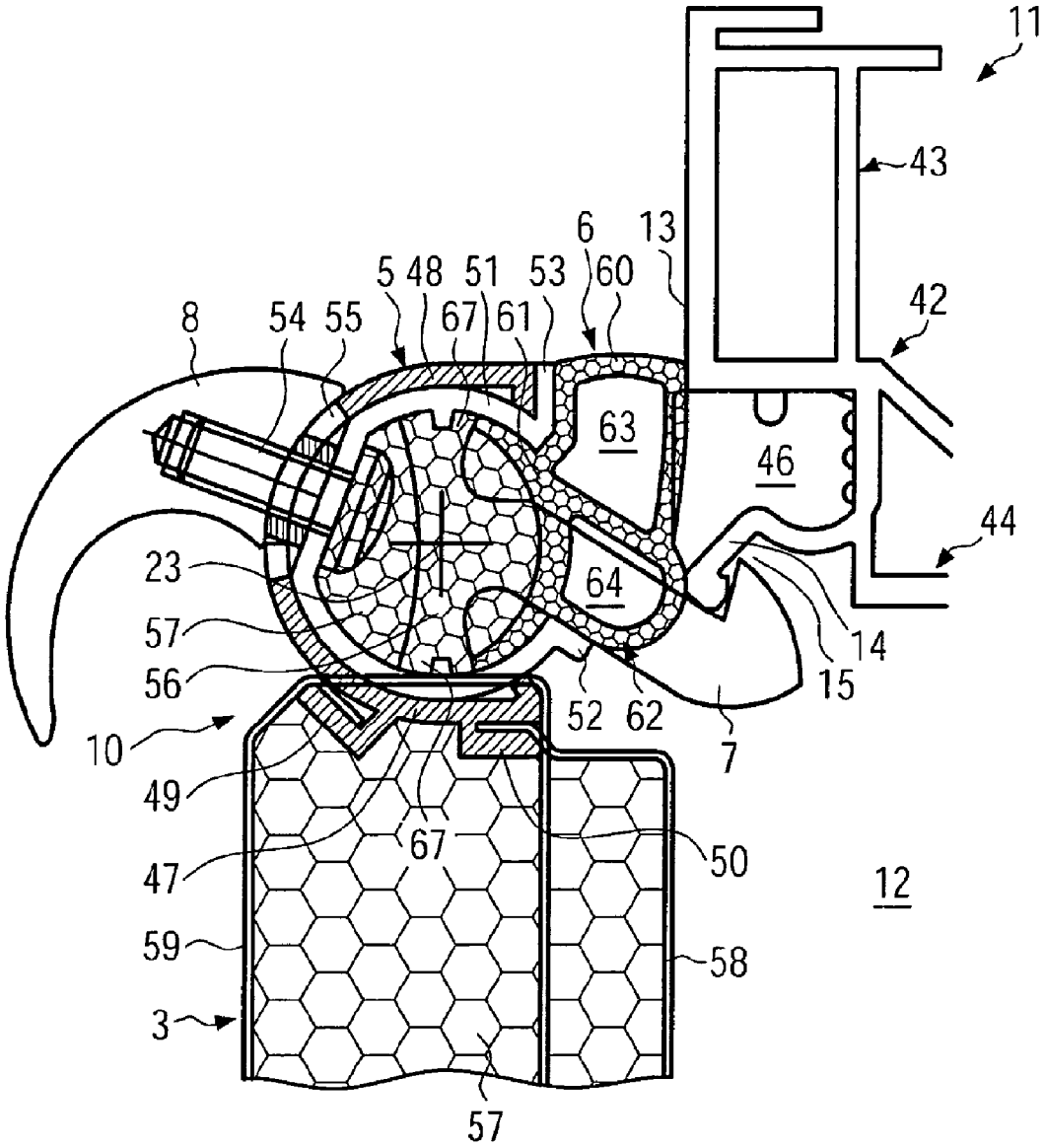
FIG. 13 A longitudinal section through the furniture closure of FIGS. 11 and 12 in the closed position.
Figure 14:
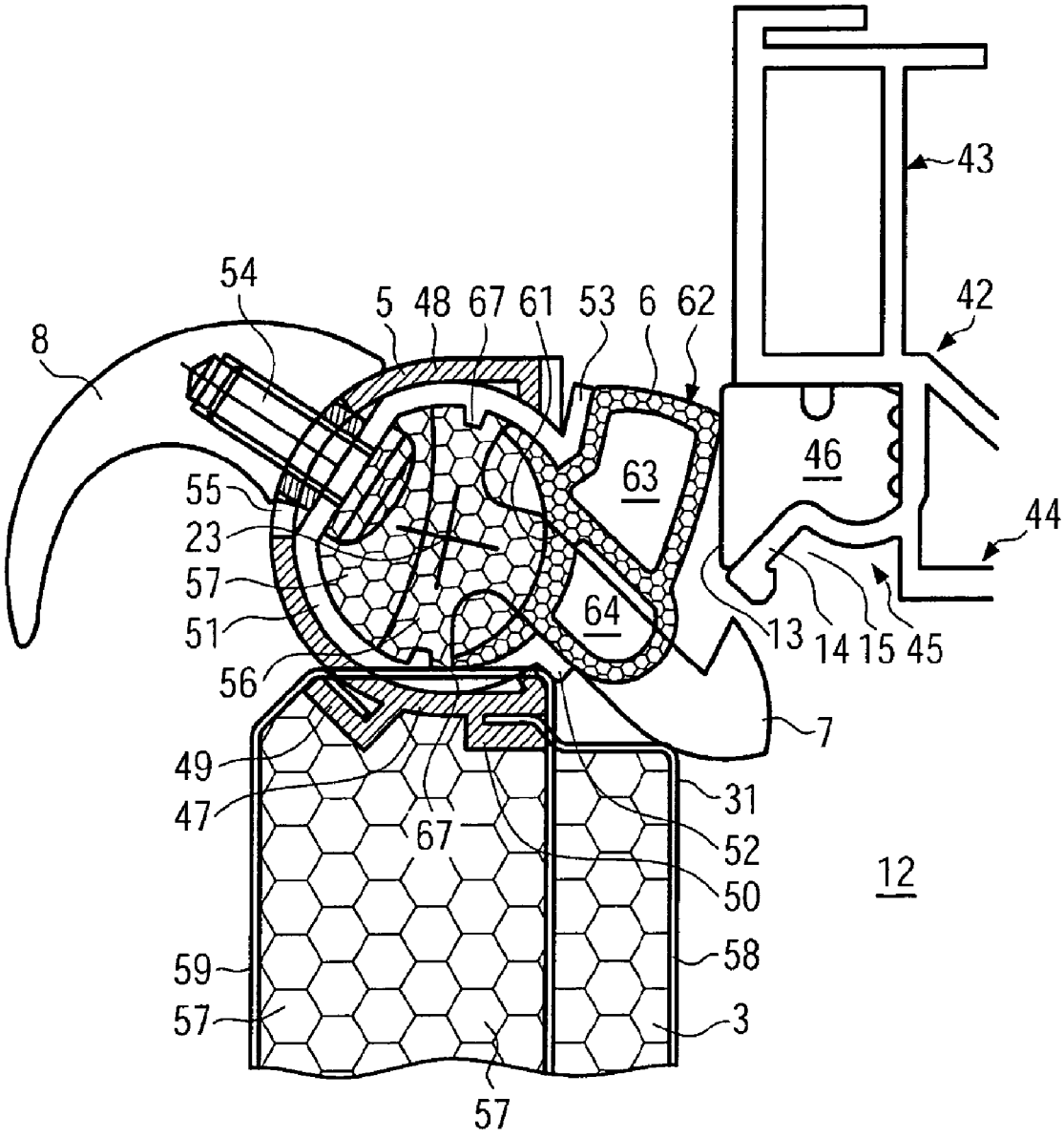
FIG. 14 A longitudinal section through the furniture closure of FIG. 13, but in the open position.

FIG. 14 shows the furniture closure of FIGS. 11 to 13 in the open position. The open position is limited in the area of the outwardly directed legs 52, 53 of the inner tube 51, in the area of the recess 5 of the profile rail 5 and by a stop member 31 for the locking member 7 on the insulating wall of the door, flap 3 or front panel of a drawer.

Figure 15:
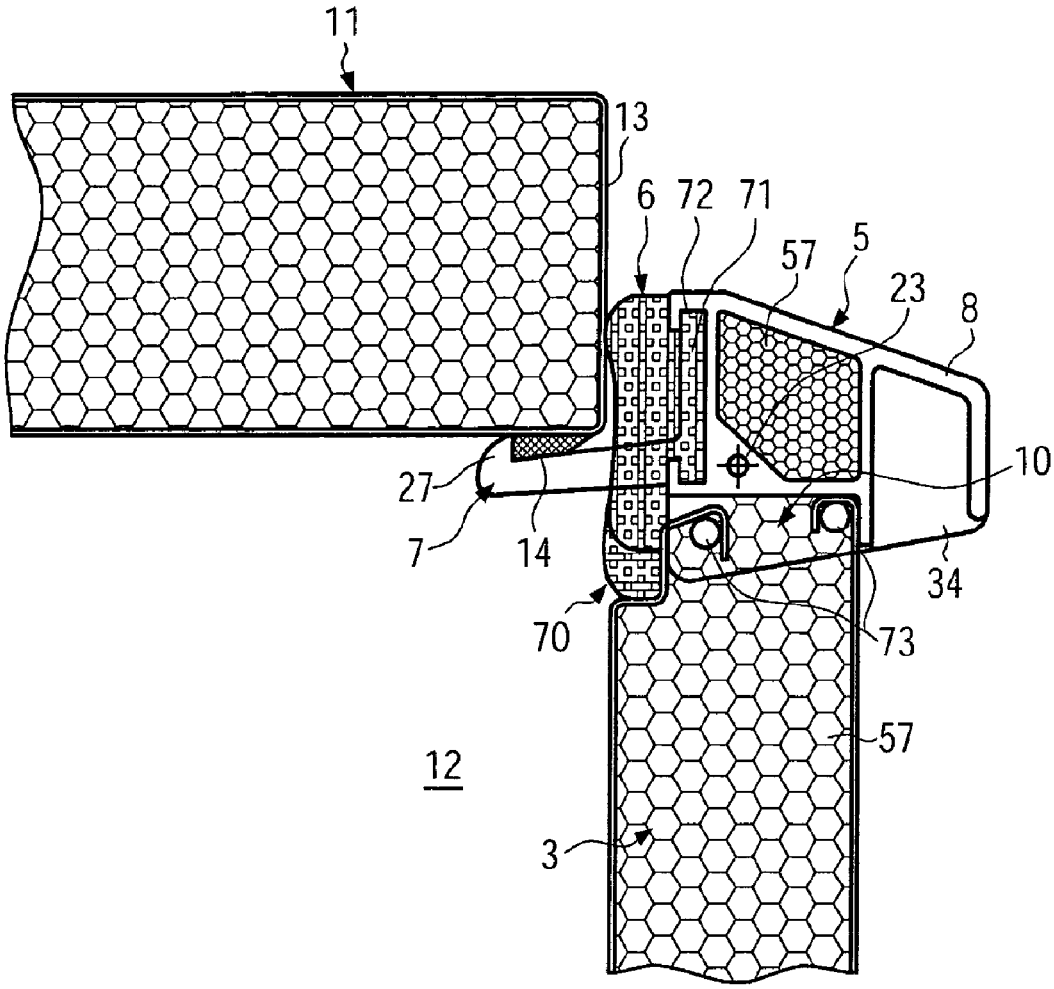
FIG. 15 A longitudinal section through a sixth variant of the inventive furniture closure in the closed position.
Figure 16:
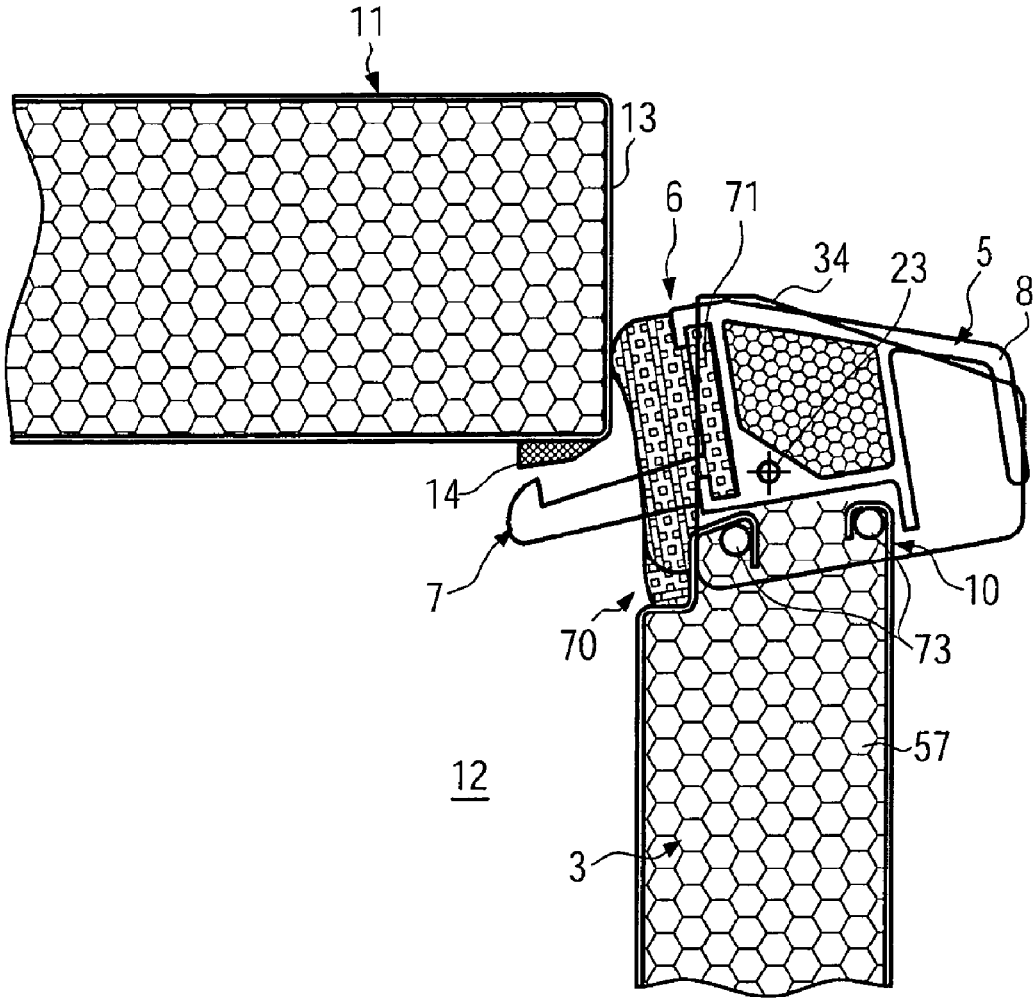
FIG. 16 A longitudinal section through the furniture closure of FIG. 15, but in the open position.

FIGS. 15 and 16 show a furniture closure largely corresponding to that of FIGS. 6 to 10. To increase the spring tension the springy seal 6 has a seal extension 70, which extends over a fastening area 71 of the seal 6 and is formed in a stepped marginal area of the door, flap or drawer front panel 3.

The profile rail 5 can be moved from the closed position shown in FIG. 15 to an open position (FIG. 16) about a longitudinal axis 23, end caps 34 on both end sides of the profile rail 5 being held in a fastening point 73 on the marginal area of the door 41 or flap 3. The springy seal 6 is held with the fastening area 71 in a roughly T-shaped fastening slot 72 of the profile rail 5. A cavity of the profile rail 5 is filled with insulating material 57 to prevent cold spots.

The locking member 7 is hook-shaped or is terminally provided with a nose 27 and engages behind a strip 14 on the furniture item 11 in the closed position (FIG. 15). The gripping strip 8 is formed on a beveled leg of the profile rail 5.

The furniture closure with a springy seal 6 and seal extension 70 is particularly suitable for profile rails 5, which do not extend over the entire length or width of a door 41 or flap 3 and are e.g. 10 to 15 cm long (cf. FIG. 18).

Figure 17:
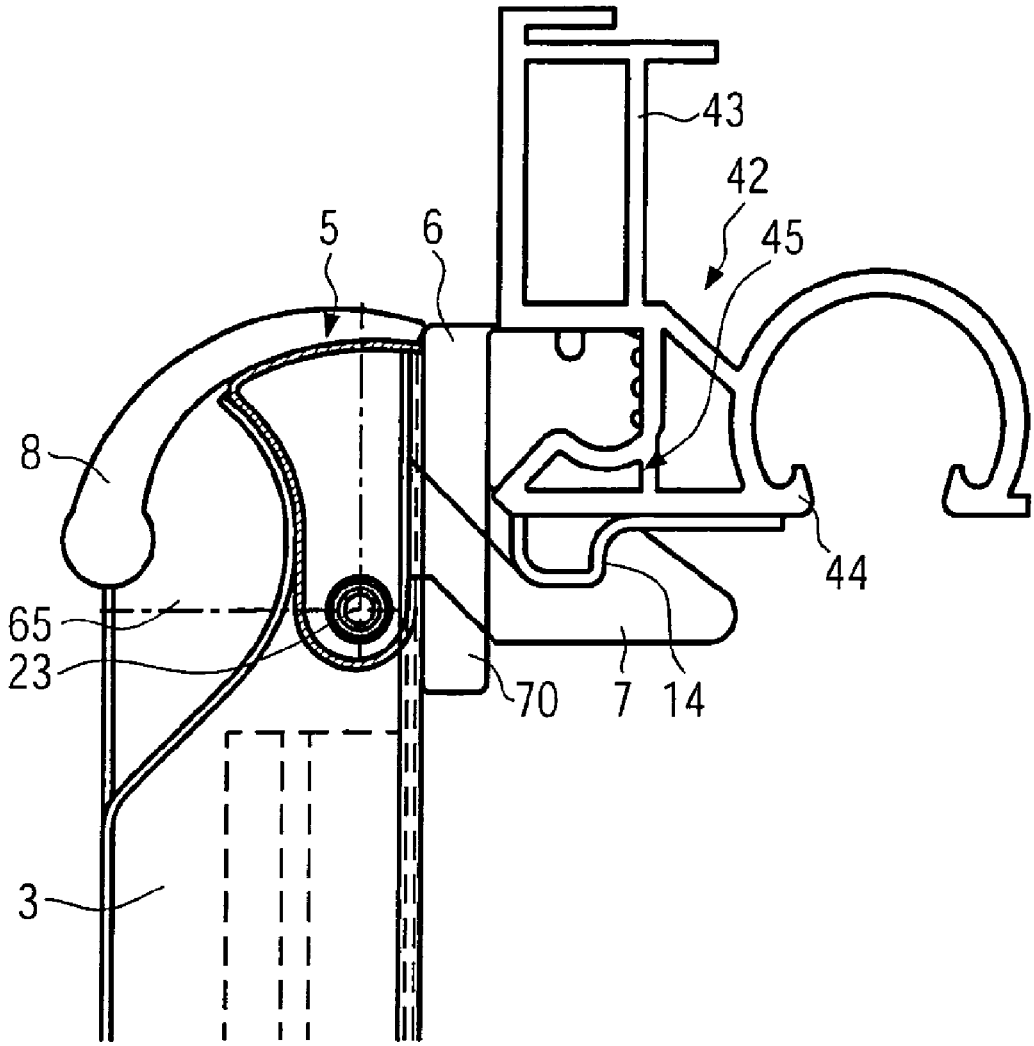
FIG. 17 A longitudinal section through a seventh variant of the inventive furniture closure in the closed position.

The furniture closure of FIG. 17 has a profile rail 5 with a longitudinal side pivot pin 23, a springy seal 6 with a seal extension 70, a locking member 7 and a gripping strip 8, the profile rail 5 being movably fixed to a marginal area of a door, flap or front panel 3 with an outside gripping recess 65. The springy seal engages in the closed position of FIG. 17 on a furniture profile 42, which is provided in an outwardly open hollow chamber with a strand-like sealing profile 46. With respect to the chamber profiles 43, 44 arranged at right angles and the profile seal 46, the furniture profile 42 corresponds to that of FIGS. 13 and 14. However, in the corner area 45 the strip 14 for the locking member 7 is arranged externally on the chamber profile 44 and locking member 7 is hook-like in complementary manner to the strip 14.

FIG. 18 shows in exemplified manner an air conditioning cabinet in the vicinity of a door 41 with a furniture closure 39 on a longitudinal side 40, which only extends over a partial area. Springy seals with a sealing extension are particularly suitable for such closures.

The invention claimed is:

1. A furniture item having an opening (12) and a catch member at the opening (12), and comprising:

a panel used to cover the opening (12), the panel being movable between open and closed positions, the panel having contact surfaces (4) projecting over the opening (12), a mating surface (13) provided on the furniture item, on which the contact surfaces (4) of the panel engage in the closed position, and a closure for the panel, the closure being movable from a retaining position, in which it retains the panel in the closed position, into a releasing position, in which it releases the panel from the closed position, and comprising:

a profile rail (5) for attachment to a marginal area of the panel, the profile rail (5) being movable from an open position to a closed position corresponding to the open position and the closed position of the panel, a locking member (7) joined to the profile rail and constructed for releasably engaging the catch member at the opening (12) in the furniture item when the closure is in the retaining position, a seal (6) joined to the profile rail and having a spring tension for biasing the locking member (7) into engagement with the catch member at the opening (12), wherein the seal (6) provides exclusive biasing of the locking member (7), and wherein the seal (6) is in an uncompressed state when the closure is in the retaining position, and a gripping strip (8) connected to the profile rail and movable towards the opening (12) for compressing the seal (6) and releasing the locking member (7) from engagement with the catch member (14) at the opening (12).

2. The furniture item according to claim 1, wherein the profile rail (5) has a longitudinal axis (23), and the profile rail (5) in combination with the seal (6) and the locking member (7) is pivotable about the longitudinal axis (23), and the spring tension of the seal (6) keeps the panel (2) in the closed position through biasing of the locking member (7) into engagement with the mating surface (13) at the opening (12).

3. The furniture item according to claim 2, wherein the longitudinal axis (23) of the profile rail (5) has one of a hinge and an articulation construction and the profile rail (5) is fixed with the aid of one of a strap, an elastomer hinge (36), a pivot joint, and with the aid of a pivot pin to the panel.

4. The furniture item according to claim 2, wherein the profile rail (5) is constructed in two parts, wherein the first part (18) has a joint (28) as well as the seal (6) and the locking member (7), and the second part (19) has a joint receptacle (29) in which the joint (28) is received, the longitudinal axis (23) of the profile rail is formed.

5. The furniture item according to claim 4, wherein the closure further comprises a knuckle joint (30) for fixing the second part (19) of the profile rail (5) to a marginal area (10) of the panel, wherein the knuckle joint (30) is constructed as a tilt stop (31) for an open position of the first part (18) of the profile rail (5).

6. The furniture item according to claim 1, wherein the seal (6) is springy and made from a material having spring tension, and in the closed position sealingly engages on the mating surfaces (13) of the furniture item (11) and is compressible for unlocking and opening the panel.

7. The furniture item according to claim 6, wherein:

the mating surface (13) of the furniture item (11) is formed by a furniture profile (42) having a profile seal (46), the furniture item further comprises a strip (14) placed on the furniture profile (42), the seal (6) is springy and made from a material having spring tension, and in the closed position sealingly engages on the mating surfaces (13) of the furniture item (11) and is compressible for unlocking and opening the panel, the front of the panel has a gripping recess (65), and the profile rail (5) is movable about a longitudinal axis (23), and the profile rail (5) with the springy seal (6), the locking member (7), and the gripping strip (8), is placed in a marginal area of the panel, and the springy seal (6) engages on the profile seal (46) of the furniture profile (42) and has a seal extension (70), and the locking member (7) has a hook construction and in the locked position engages the catch member that is positioned behind the strip (14), which is constructed in complementary manner.

8. The furniture item according to claim 1, wherein the seal (6) is at least one of:

made from one of an elastomer plastic and foamed rubber and constructed as one of a lip seal and a cellular seal.

9. The furniture item according to claim 1, wherein the seal (6) is made from a sealing and insulating material.

10. The furniture item according to claim 1, wherein the profile rail (5) is provided with at least one tilt stop (31, 37), which limits the pivoting movement of the profile rail (5) into the open position.

11. The furniture item according to claim 1, wherein in cross-section the profile rail (5) is one of approximately I-shaped and approximately T-shaped, and has a vertical leg (20) and a horizontal leg (21), the horizontal leg (21) being externally provided with the gripping strip (8) and the profile rail (5) is pivotably fastened in the area of the vertical leg (20).

12. The furniture item according to claim 1, wherein the seal (6) is held one of in and on the profile rail (5) and the profile rail (5) and seal (6) are arranged horizontally and extend in an upper area over the width of the panel.

13. The furniture item according to claim 1, wherein the profile rail (5) is made from one of a plastic and a metal.

14. The furniture item according to claim 1, wherein the catch member is a strip (14) at one side of the opening and the locking member (7) is constructed as a catch member for engaging behind the strip (14) when the panel (2) is in the closed position.

15. The furniture item according to claim 1, wherein the catch member is a slot (15) at one side of the opening and the locking member (7) is integrated into the profile rail (5) and is constructed for engaging in the slot (15).

16. The furniture item according to claim 1,
wherein
the construction of at least one of the seal (6) and the locking member (7) and the contact surface (4) and the inside (16) of the panel limits the open position of the profile rail (5).

17. The furniture item according to claim 1,
wherein the closure further comprises
a retaining member (9) positioned in the profile rail (5).

18. The furniture item according to claim 17,
wherein
the retaining member (9) is vertically movable and constructed as a plug-in lock for holding the panel in the closed position via the profile rail (5).

19. The furniture item according to claim 17,
wherein
the retaining member (9) has a closed position and an open position, and is held in the closed position on an outside (17) of the contact surface (4) and in the open position projects over the profile rail (5).

20. The furniture item according to claim 1,
wherein
the closure further includes a rotary inner tube (51),
the seal (6) is springy and made from a material having spring tension, and
in cross-section the profile rail (5) is one of roughly semicircular and U-shaped and is constructed for receiving the rotary inner tube (51), and the gripping strip (8), the seal (6), and the locking member (7) are fixed to the rotary inner tube (51) and are movable from a closed position into an open position and vice versa.

21. The furniture item according to claim 20,
wherein
the springy seal (6) is constructed as a cellular seal (60) and has a sealing foot (61) for fixing to the inner tube (51) and a sealing head (62) with at least one cell (63, 64) constructed for flat engagement on the mating surface (13) of the furniture item (11).

22. The furniture item according to claim 21,
wherein
the profile rail (5) is U-shaped and has a U-opening and relatively short U-legs (47, 48) with inwardly angled leg ends, and on one of the U-legs (47) are formed profile feet (49, 50) for fixing the profile rail (5) to a marginal area of the panel.

23. The furniture item according to claim 22,
wherein
the inner tube (51) has a longitudinal opening complementary to the U-opening of the profile rail (5), the springy seal (6) being provided in the area of the longitudinal opening, and the inner tube (51) projects outwards with the sealing head (62) and the gripping strip (8) is fixed to the rotary inner tube (51) roughly facing the longitudinal opening with the aid of fixing members (54).

24. The furniture item according to claim 23,
wherein
at least in the vicinity of the fixing members (54), the profile rail (5) has a recess (55) for the rotary adjustment of the inner tube (51) with springy seal (6), locking member (7) and gripping strip (8) about a longitudinal axis (23), recess (55) being dimensioned in such a way that the opening movement of the inner tube (51) is limited.

25. The furniture item according to claim 20,
wherein
the mating surface (13) of the furniture item (11) is formed by a furniture profile (42), which has chamber profiles (43, 44) at right angles to one another, a corner area (45), a slot (15) in the catch member for the engagement of the locking member (7) in the closed position, and a profile seal (46) received in the corner area (45), the corner area (45) being constructed for receiving said profile seal (46).

26. The furniture item according to claim 25,
wherein
the furniture profile (42) includes a profile recess for the profile seal (46) and a strip (14), the springy seal (6) of the profile rail (5) engages in the closed position on the profile seal (46) and on the strip (14) of the furniture profile (42), the strip (14) terminally running roughly diagonally in the corner area (45) and separates the profile recess for the profile seal (46) from the slot (15) for receiving the locking member (7).

27. The furniture item according to claim 20,
wherein
the closure further comprises fixing struts (56), and
the locking member (7) is fixed in the inner tube (51) with the aid of the fixing struts (56).

28. The furniture item according to claim 20,
wherein
for avoiding cold spots and for the additional retention of the springy seal (6) and locking member (7), the inner tube (51) is foamed with an insulating material (57).

29. The furniture item according to claim 20,
wherein
the profile rail (5) with movable inner tube (51), springy seal (6), at least one locking member (7) and gripping strip (8) is positioned horizontally, on an upper marginal area of the panel.

30. The furniture item according to claim 20,
wherein
the panel is a door (41), and
the profile rail (5) with movable inner tube (51), springy seal (6), at least one locking member (7) and gripping strip (8) is positioned vertically on a partial area of a longitudinal side (40) the door (41).

31. The furniture item according to claim 30,
wherein:
the profile rail (5) has a fastening slot (72), and
the springy seal has a seal extension (70) for increasing the spring tension and a fastening area (71) with which the springy seal (6) is received in the fastening slot (72), and the seal extension (70) extends over the fastening area (71).

32. The furniture item according to claim 31,
wherein
the profile rail (5) is frontally provided with end caps (34), which are fixable in fastening points (73) on the marginal area of the panel.

33. The furniture item according to claim 1,
wherein
the panel is a door,
the seal (6) is held one of in and on the profile rail (5),
the profile rail (5) and seal (6) are arranged vertically on a longitudinal side of the door over a partial area of the door, and
the closure further comprises additional seals (6) located on the remaining sides of the door panel.

34. The furniture item according to claim 1,
wherein
the profile rail (5) and the locking member (7) are constructed in one piece.

* * * * *